United States Patent [19]

Walsh

[11] Patent Number: 4,461,969

[45] Date of Patent: Jul. 24, 1984

[54] INCANDESCENT ELECTRIC LAMP WITH MEANS FOR REDUCING EFFECTS OF DEPOSITION OF FILAMENT MATERIAL

[75] Inventor: Peter Walsh, Stirling, N.J.

[73] Assignee: Duro-Test Corporation, North Bergen, N.J.

[21] Appl. No.: 264,473

[22] Filed: May 18, 1981

Related U.S. Application Data

[63] Continuation of Ser. No. 959,459, Nov. 13, 1978, abandoned.

[51] Int. Cl.[3] ..... H01K 1/32

[52] U.S. Cl. ..... 313/113; 313/315; 313/578

[58] Field of Search ..... 313/113, 114, 315, 566, 313/578, 580

[56] References Cited

U.S. PATENT DOCUMENTS

| | | | |
|---|---|---|---|
| 2,001,528 | 5/1935 | Groot et al. | 313/113 X |
| 2,221,629 | 11/1940 | Birdseye | 313/113 |
| 2,398,968 | 4/1946 | Singer | 313/114 |
| 2,859,369 | 11/1958 | Williams et al. | 313/113 |
| 2,918,595 | 12/1950 | Cressman | 313/113 |
| 2,980,818 | 4/1961 | Harris et al. | 313/113 |
| 3,209,188 | 9/1965 | Freeman | 313/113 X |
| 3,325,666 | 6/1967 | Bird et al. | 313/113 |
| 4,160,929 | 7/1979 | Thorington et al. | 313/112 |

*Primary Examiner*—Eugene R. Laroche
*Attorney, Agent, or Firm*—Darby & Darby

[57] ABSTRACT

An incandescent electric lamp having a filament which incandesces and produces a vapor of the metal of the filament which normally deposits on the wall. A coating is placed on the filament wall where the majority of the vapor would normally deposit to act as a reflecting coating so that the visible energy reflected from the coating will be transmitted through a portion of the wall which is not blackened by the vapor. The coating thickness is adjusted so that the deposit from the filament builds up on a nodal surface so that light absorption is small.

19 Claims, 5 Drawing Figures

INCANDESCENT ELECTRIC LAMP WITH MEANS FOR REDUCING EFFECTS OF DEPOSITION OF FILAMENT MATERIAL

This application is a continuation of prior application Ser. No. 959,459 filed Nov. 13, 1978, which application is assigned to the same assignee as this application, which is now abandoned.

Conventional incandescent electric lamps are generally of two types, these being the so-called clear glass envelopes and those with a "frosted" coating. Another type of lamp utilized is a coating which is both reflective to infrared (IR) energy produced by the incandescent filament and also light transmissive to the visible energy produced by the filament.

In lamps of the clear glass type and those with a coating for transmitting visible and reflecting IR energy, a problem is encountered over a certain area of the envelope which is caused by the operation of the filament, this filament generally being of tungsten. That is, after a certain time of operation, usually only a few hundred hours, an amount of material is boiled off, or vaporized, from the filament and deposits on the wall of the envelope. This darkens the wall of the envelope and, in these areas, the visible light is absorbed and cannot be passed therethrough. This reduces the overall light output of the lamp and its efficiency. In lamps of the type with an IR reflective coating, the darkening of the wall also reduces the ability of the darkened wall section to reflect the IR energy back to the filament. This also reduces the operating efficiency of the lamp since a part of the IR energy is not reflected back to the filament and this loss of IR energy at the filament lowers its operating temperature.

To improve the efficiency of the aforesaid types of lamps, it is desired to reduce the effect of the blackening by the filament material. The present invention relates to a mechanism for doing this without altering the filament design or putting any additional physical structure in the envelope. In accordance with the invention, there is deposited on the wall of the envelope, during manufacture of the lamp, in the area where the filament material would be deposited, a special internal reflecting layer designed to maintain high reflectivity in the presence of deposition of filament material. This layer reflects the visible energy internally of the lamp so that this energy, rather than being lost, is reflected back into another portion of the lamp where it can be transmitted through the envelope. The filament material coating also can be used in conjunction with an IR reflective coating.

It is therefore an object of the present invention to provide an incandescent electric lamp with an internally reflective coating on a portion of the lamp where vaporized filament material would be deposited to reflect visible light therefrom, said coating designed to maintain high reflectivity in the presence of the vaporized material.

A further object is to provide an incandescent lamp having a coating thereon formed by discrete layers of a metal and a dielectric material to reflect visible energy.

An additional object is to provide an incandescent electric lamp having a coating on a selected area where material would normally be deposited from the filament to reflect visible light from this area while having the filament material deposited thereon.

Another object is to provide an incandescent lamp with an IR reflective coating and including a further coating for reflecting visible light from an area of the envelope where filament material is deposited.

Other objects and advantages of the present invention will become more apparent upon reference to the following specification and annexed drawings in which.

Figure 1:
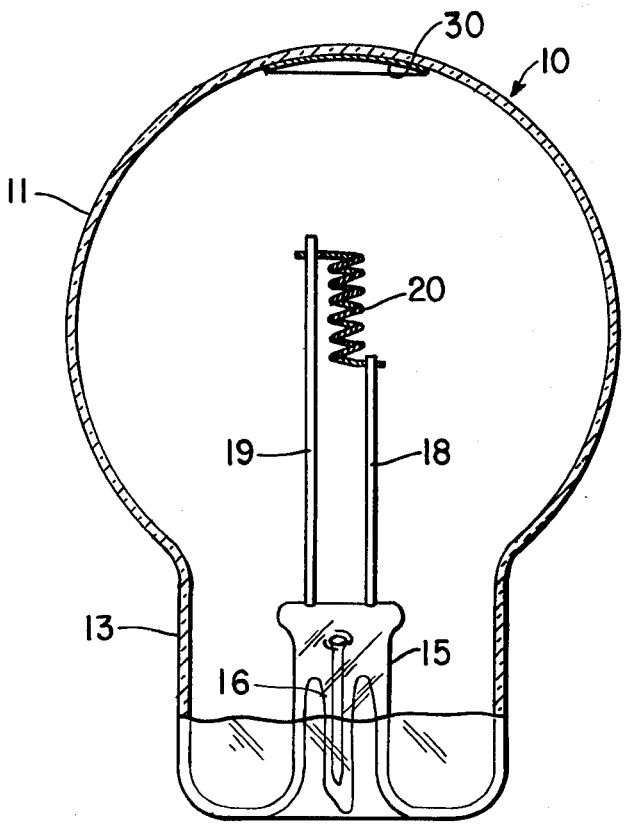
FIG. 1 is an elevational view in cross-section showing an incandescent lamp in accordance with the subject invention.

Referring to FIG. 1, the incandescent lamp 10 of the invention includes an envelope 11 of glass, such as lime glass or borosilicate glass, or other similar material. The envelope is shown as being generally spherical in shape although any conventional bulb shape or envelopes with special optical shapes, such as an ellipsoid, can be used in accordance with the general principles of the invention.

The envelope 11 has a neck portion which is formed with a reentrant stem 15 having a tubulation 16 thereon. The interior of the envelope 11 is exhausted through the tubulation 16 and then filled with a gas, if this is desired. The tubulation is then tipped off. The lamps of the invention can operate either as a vacuum type or as a gas filled lamp, for example with argon or some other conventional type of gas used with incandescent lamps. A high molecular weight gas, such as krypton, also can be used.

Extending from the stem 15 is a pair of lead-in wires 18 and 19, these wires being relatively stiff. The bottom ends of the wires are connected to a base of conventional construction, for example, of the screw or bayonet type to make electrical contact therewith, the base being able to be placed into a socket. The base is not shown for purposes of clarity.

A filament 20 is mounted to the lead-ins 18 and 19. The filament is of any conventional construction and can have any shape. While the filament is shown as being elongated and vertically mounted, it can be horizontally mounted and while it is shown as being elongated in shape it can be of a more conventional part-circular configuration. The particular type and shape of filament is not critical to the subject invention. The filament is usually of tungsten, either plain or doped, and can be either single, double or triple coiled. The particular construction and material of the filament, in themselves, are not critical to the present invention. Refractory materials other than tungsten can be used.

As heretofore decribed, the lamp is of generally conventional construction and the invention has applicability with respect to otherwise conventional lamps. Referring to FIG. 1, the envelope is considered to be of clear glass. Depending upon the shape of the filament and is mounting, there will be an area of the envelope 11 of the lamp which will be blackened due to filament material being evaporated from the filament 20 and deposited on the envelope. In a mounting arrangement of the type shown in FIG. 1, this generally will be a more or less circular area at the top of the lamp above the filament, assuming that the lamp is being burned base down as shown in FIG. 1. That is, the majority of the material vaporized from the filament will drift up due to convection currents within the envelope.

In the area where the darkening occurs, the visible light energy produced by the filament would normally be absorbed and not be transmitted through the envelope. If this area, for example, occupies 10% of the surface area of the envelope, then the light output of the envelope and its efficiency are reduced correspondingly.

It is estimated that in a lamp with a clear glass envelope using a tungsten filament, that after about 100 hours of operating a film of tungsten is deposited which produces a loss in the visible range of light transmission in the area of deposition of about 50%-60%. In the case of an IR reflective coating lamp, about 30%-40% of the IR energy would be lost, that is, it would not be reflected back toward the filament from the area where the darkening occurred.

To overcome this problem, in accordance with the invention, the area where the darkening would normally occur is covered with an internal reflecting coating which is generally designated 30 and shown in greatly enlarged form in FIG. 1. The coating 30 is normally placed only over that area where the darkening would be expected to occur. The coating does not have to have any special shape. It can be, for example, circular or can have a generally circular pattern.

The coating 30 has the following properties:

1. A high reflectivity to visible light in the absence of filament material deposition. Where the lamp is of the IR reflecting type, the coating also has a high reflectivity to IR energy.
2. The coating maintains its high reflectivity in the presence of filament material deposition. Thus, the coating maintains a significantly lower loss of visible energy while the filament material deposit builds upon on it than would occur if the material built up directly on the lamp envelope. Where the lamp is of the IR reflecting type, the property also is present with respect to the IR energy.

It has been found that these conditions are satisfied by a two layer composite coating, one of the layers being a metal and the other being a dielectric which provides phase matching properties for the metal. The composite coating is designed to reflect visible and IR light which passes through the evaporated filament material. By choosing the thickness of the dielectric layer properly, high reflectivity can be maintained over the range of thickness of evaporated material normally encountered during the life of the lamp.

Figure 2:
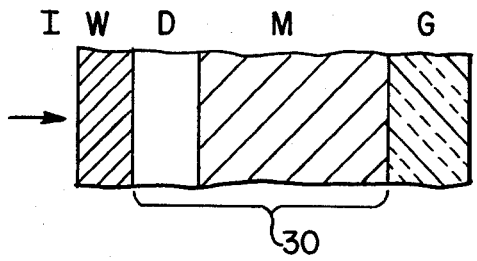
FIG. 2 is an enlarged fragmentary view of a portion of the lamp of FIG. 1 showing the envelope-coating interface.

FIG. 2 is a diagram showing the various interfaces in a clear glass lamp using the coating 30. The letters indicate the following:

I = the interior of the envelope with the arrow showing the direction of incident light emitted from the filament and the direction of motion of the evaporated filament material and IR energy.

W = the layer of filament material (e.g. tungsten) having a thickness $h_w$.

D = the dielectric layer having a thickness $h_D$, and index $n_D$.

M = the metal layer, whose index is mainly complex and given by $n_M = K_M$.

G = the glass of the envelope.

In the lamp, the energy from the filament passes through the layer W of filament material and is reflected by the dielectric-metal composite coating 30 at the dielectric-metal interface.

The layer W will absorb the least energy if it is located at a nodal position where the electric field of the light is zero. The nodes are located at positions where the phase difference from the node to the dielectric-metal interface and back is a multiple of radians ($0\pi$, $\pm\pi$, $\pm 2\pi$, $\pm 3\pi$, etc.). The phase difference, A, due to travel in the dielectric layer is $2\pi 2h_D/\lambda$ while the phase difference, B, upon reflection from M is $B = -2\tan^{-1}(K_M/n_D)$. The wavelength is $\lambda$. Minimum absorption in W and maximum reflection occurs at $A+B=0$, $\pm\pi$, $\pm 2\pi$, etc.

The selection of the metal M and dielectric D and the thicknesses of these films depends upon certain design criteria. In the case of a clear glass lamp, the reflection of IR energy is not of consequence, while in an IR reflective lamp, it is. In both types of lamp, the metal should have a high reflectance to light in the visible range.

A difficulty arises when the equation for minimum absorption, given above, is applied to an IR reflective lamp, where the condition is required to hold over a wide range of wavelengths. Now A decreases with increasing $\lambda$ and, since for many metals $K_M$ increases as $K_M \cong a\lambda$, B increases in magnitude with $\lambda$. However, at a particular dielectric thickness, $h_D$, it can be shown that the increase in magnitude of B (which is negative) offsets the decrease in A. For this thickness of dielectric the minimum absorption holds over a wide range typically from the visible and over the entire infrared. This optimum dielectric thickness is just $h_D = 1/(2\pi a)$ and is independent of dielectric index. Where the metal is aluminum, gold or silver, the thickness $h_D$ respectively is about 170 Å, 280 Å and 230 Å with variations of ±15%.

Using the foregoing criterion, the transmission matrices can be evaluated for the various interfaces. Reference is made to AIP Handbook, 3rd Edition, McGraw Hill (1972), Section 6g-6.

In general, it has been found that for the material for the metal layer 17, silver is a good reflector to visible light and can be deposited easily on glass. Other suitable, but less effective, metals are gold, aluminum, copper and the alkali metals, that is, metals having a refractive index which is predominantly imaginary. Suitable dielectrics are magnesium fluoride, cryolite or titanium dioxide, but most nonabsorbing dielectrics are acceptable.

In a typical lamp, using a silver-titanium dioxide composite coating, where the filament produces a peak emission in the visible range of about 580 nm, the thickness of the silver would be greater than about 300 Å and the dielectric thickness from about 195 Å to 265 Å.

Rather than use a dielectric-metal composite coating, a metal layer only can be used in the area where the filament material will be deposited. However, using the metal only is not as efficient as the composite.

Figure 3A:
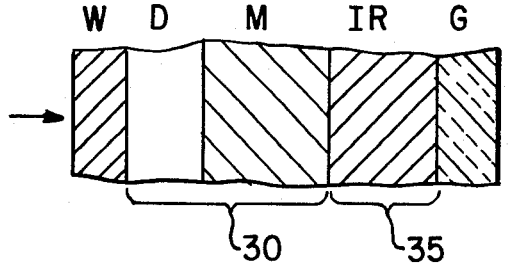
FIG. 3A is an enlarged fragmentary view of a portion of the lamp of FIG. 3 showing the envelope-coating interface.
Figure 3:
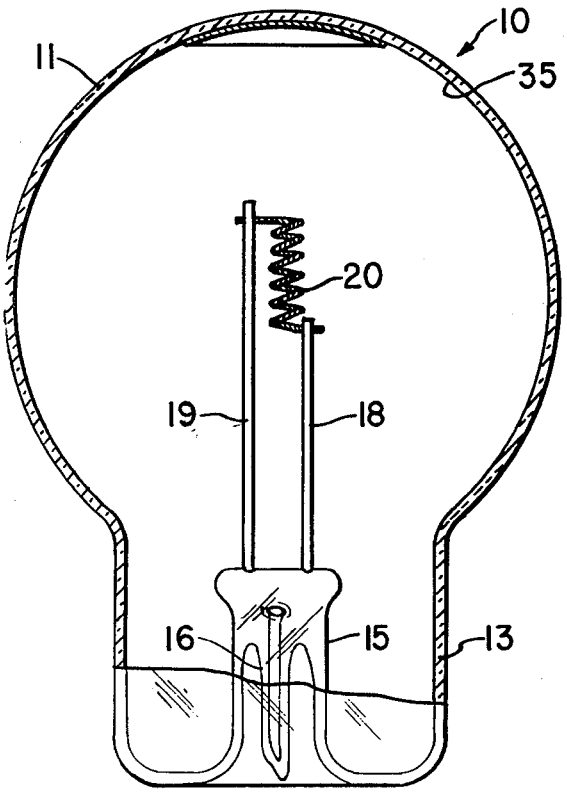
FIG. 3 is a view of a further embodiment of the invention.

FIG. 3 is a view of a lamp with an IR reflecting coating. From outward appearances, it resembles the lamp of FIG. 1. The envelope is optically shaped to reflect IR energy produced by the filament back to it. The filament is optically centered in the envelope or it can be deliberately misaligned as set forth in my copending application Ser. No. 952,267, filed Oct. 18, 1978, which is assigned to the same assignee. Also, an IR reflective coating 35 is deposited on the interior of the envelope 11. The coating can be of any suitable type, sample coatings described in copending application Ser. No. 781,355, filed Mar. 7, 1977, now U.S. Pat. No. 4,160,929 granted July 10, 1979, and Ser. No. 863,155, filed Dec. 22, 1977, both of which are assigned to the assignee of the subject application. There are three discrete layers for each of the coatings, the former being of a metal sandwiched between two dielectrics and the latter of a dielectric sandwiched between two metals. The coating 35 reflects a substantial portion of the IR energy back to the filament and permits a substantial portion of the visible energy to pass. The reflected IR energy acts to tend to raise the operating temperature of the filament and thereby reduce the input power needed to produce the same operating temperature.

FIG. 3A shows the interface of the envelope (G) and the two coatings 30,35, the latter being designated IR. The mathematical treatment is generally the same as the the case of FIG. 2.

The dielectric-metal coating 30, serves the same purpose as previously described with respect to the lamp of FIG. 1. That is, it reflects the visible energy which passes through the layer W of deposited filament material and maintains W at a nodal position to minimize light absorption in W. The metal layer of coating 30 also serves a function in reflecting IR energy that falls upon it back to the filament. If any IR energy passes through coating 30, it is reflected by coating 35. However, there would be a substantial loss in the two-way transmission of the IR energy through coating. Thus, effectively the IR reflective coating 35 can be omitted in the area where the coating 30 is laid down.

Figure 4:
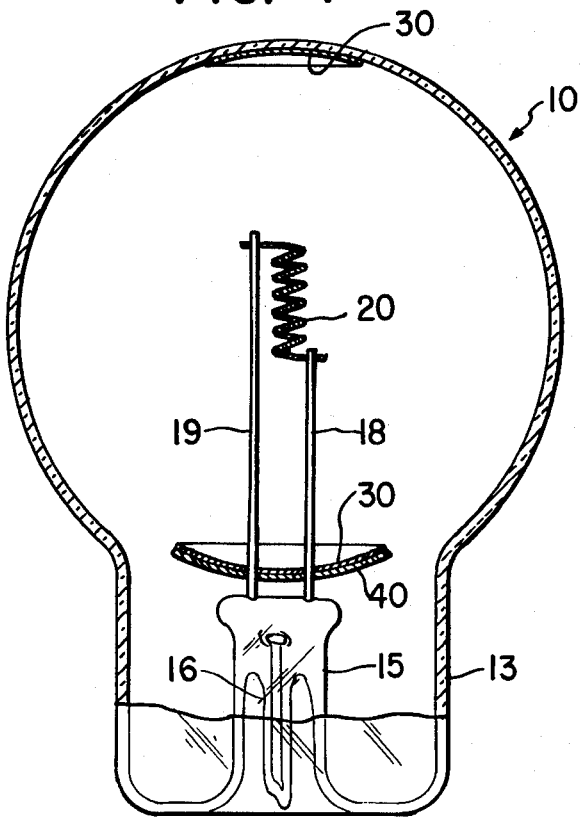
FIG. 4 is an elevational view of a further embodiment.

FIG. 4 shows a further embodiment of the invention. Here, a curved collector 40 is located below the filament and also has the coating 30 thereon. The top of the envelope also has the coating 30 in the area where the filament material will be deposited. Thus, filament material which vaporizes from the bottom of the filament collects on the collector 40 rather than at the neck of the lamp. The operation of the coating 30 on collector 40 is the same as previously described, that is, it reflects the visible energy. Reflector 40 and its coating 30 are particularly effective when the lamp is burned base up.

The collector 40 is also shown as optically shaped, for example it is concave, to serve as a reflector to reflect IR energy back to the filament 20. The latter feature is useful in lamps with an IR reflective coating, whether burned base up or base down. This feature is not required in a normal lamp.

The coating 30 can be placed on the lamp envelope by any suitable technique, for example, chemical or vapor deposition, sputtering, vacuum deposition, etc. These techniques are well known to the art.

What is claimed is:

1. An incandescent electric lamp comprising:

an envelope of material which is transmissive to visible light, incandescent filament means within said envelope, means for supplying electrical energy to said filament means to cause it to incandesce to produce energy at least in the visible range, the incandescence of the filament means producing a heated gas stream and vaporizing material therefrom, the major portion of which vaporized filament material moves by convection in the heated gas stream in the direction of the flow of the heated gas stream to the wall of the envelope and deposits over a substantially predetermined area of the internal surface thereof in accordance with the orientation of the envelope relative to the direction of the flow of the heated gas stream, said predetermined area being a minor part of the overall surface area of said envelope, and means on substantially only said predetermined area of the envelope on which the vaporized filament material deposits for maintaining high reflectivity for visible light energy incident on said area while said deposit of filament material builds thereon to reflect therefrom substantially all of the incident visible light energy directly to another part of the envelope which is transmissive to visible light.

2. An incandescent electric lamp as in claim 1 wherein said filament means also produces infrared energy and wherein said means for maintaining high reflectivity comprises a coating of a material which reflects the visible light energy and which also reflects a substantial portion of the infrared energy produced by said filament means back thereto when a deposit of the vaporized filament material is thereon.

3. An incandescent electric lamp as in claim 1 wherein said means for maintaining high reflectivity comprises a metal.

4. An incandescent electric lamp as in either of claims 1 or 2 wherein said means for maintaining high reflectivity is a coating which is a composite of at least two layers of different materials, one of said layers being a metal with said layer of metal being the layer most remote from said filament.

5. An incandescent electric lamp as in claim 4 wherein the metal has an index of refraction which is predominantly imaginary.

6. An incandescent electric lamp as in claim 5 wherein the other material is a dielectric material in which the phase difference of the visible light travelling therethrough substantially matches the phase difference of the visible light reflected from said layer of metal.

7. An incandescent electric lamp as in claim 6 wherein the dielectric material has a thickness of substantially $1/(2\pi a)$, where a is the slope of the complex part of the dielectric constant versus wavelength.

8. An incandescent electric lamp as in claim 4 wherein the other material is a dielectric material in which the phase difference of the visible light travelling therethrough substantially matches the phase difference of the visible light reflected from said layer of metal.

9. An incandescent electric lamp as in claim 8 wherein the dielectric material has a thickness of substantially $1/(2\pi a)$, where a is the slope of the complex part of the dielectric constant versus wavelength.

10. An incandescent electric lamp as in claim 8 wherein the metal is silver.

11. An incandescent electric lamp as in claim 2 further comprising a coating which reflects infrared energy back to said filament means and which is also transmissive to visible light range energy on the envelope over at least the portion thereof other than said predetermined area where the first-named visible light reflecting coating is located.

12. An incandescent electric lamp as in claim 11 wherein the first-named visible light transmissive coating and the infrared reflecting coating are superposed at said predetermined area.

13. An incandescent electric lamp comprising:

an envelope of material which is transmissive to visible light, incandescent filament means within said envelope, means for supplying electrical energy to said filament means to cause it to incandesce to produce energy in the visible range and in the infrared range, the incandescence of the filament means vaporizing material therefrom which moves by convection to the wall of the envelope and deposits over a substantially predetermined area thereof in accordance with the shape of the filament means and its orientation within said envelope, and means substantially only on said predetermined area of the envelope on which the filament material deposits for maintaining high reflectivity for the visible range and infrared range radiant energy incident on said area produced by the filament in both the visible and the infrared ranges while said deposit of filament material builds up thereon to reflect the visible range position of the incident radiant energy directly to another part of the envelope which is transmissive to visible light and to reflect the infrared portion of the energy incident thereon to said filament.

14. An incandescent electric lamp as in claim 13 wherein said means for maintaining high reflectivity comprises a metal.

15. An incandescent electric lamp as in claim 13 wherein said means for maintaining high reflectivity comprises a coating of a composite of a layer of a metal and a layer of a dielectric material in which the phase difference of the visible light travelling therethrough substantially matches the phase difference of the visible light reflected from said layer of metal.

16. An incandescent electric lamp as in claim 15 wherein the layer of dielectric material has a thickness substantially equal to $1/(2\pi a)$, where a is the slope of the complex part of the dielectric constant versus wavelength.

17. An incandescent electric lamp comprising:

an envelope of material which is transmissive to visible light, incandescent filament means within said envelope, means for supplying electrical energy to said filament means to cause it to incandesce to produce radiant energy both in the visible and in the infrared range, the incandescence of the filament means vaporizing material therefrom the major portion of which vaporized filament material moves by convection to the wall of the envelope and deposits over a substantially predetermined area of the internal surface thereof in accordance with the shape of the filament means and its orientation within said envelope, said predetermined area being a minor part of the overall surface area of said envelope, and means substantially only on said predetermined area of the envelope on which the filament material deposits for maintaining a high reflectivity for the visible range and infrared range radiant energy incident on said area while said deposit of filament material builds up thereon to reflect the incident radiant energy to another portion of the envelope, said means including a layer of a dielectric material having a thickness substantially equal to $1/(2\pi a)$, where a is the slope of the complex part of the dielectric constant versus wavelength.

18. An incandescent electric lamp as in claim 17 wherein said means for maintaining high reflectivity also includes a layer of a metal juxtaposed with the layer of dielectric material.

19. An incandescent electric lamp as in claim 17 further comprising means on said envelope at a portion other than said predetermined area for both reflecting infrared range energy produced by the filament and for transmitting therethrough visible light range energy produced by said filament.

* * * * *